US008628163B2

(12) United States Patent
Kanematsu et al.

(10) Patent No.: US 8,628,163 B2
(45) Date of Patent: Jan. 14, 2014

(54) INK JET PRINTING APPARATUS AND PRINTING METHOD

(75) Inventors: Daigoro Kanematsu, Yokohama (JP); Kazuo Suzuki, Yokohama (JP); Taku Yokozawa, Yokohama (JP); Satoshi Hayashi, Yokohama (JP); Yuhei Oikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 618 days.

(21) Appl. No.: 12/633,331

(22) Filed: Dec. 8, 2009

(65) Prior Publication Data

US 2010/0156977 A1 Jun. 24, 2010

(30) Foreign Application Priority Data

Dec. 19, 2008 (JP) ..... 2008-323733

(51) Int. Cl.
*B41J 29/377* (2006.01)

(52) U.S. Cl.
USPC ..... 347/17; 347/5; 347/14

(58) Field of Classification Search
USPC ..... 347/12, 16, 14, 15, 5, 9, 17, 19
See application file for complete search history.

(56) References Cited

U.S. PATENT DOCUMENTS

| | | | |
|---|---|---|---|
| 5,130,726 | A | 7/1992 | Fukushima et al. |
| 5,940,094 | A | 8/1999 | Otsuka et al. |
| 6,019,448 | A | 2/2000 | Yano et al. |
| 6,331,039 | B1 | 12/2001 | Iwasaki et al. |
| 6,375,297 | B1 | 4/2002 | Hayashi et al. |
| 6,390,583 | B1 | 5/2002 | Kato et al. |
| 6,394,571 | B1 | 5/2002 | Yano et al. |
| 6,450,606 | B1 | 9/2002 | Kato et al. |
| 6,474,768 | B1 | 11/2002 | Yano et al. |
| 6,494,557 | B1 | 12/2002 | Kato et al. |
| 6,505,909 | B1 | 1/2003 | Kato et al. |
| 6,652,058 | B2 | 11/2003 | Kanematsu et al. |
| 6,767,080 | B2 | 7/2004 | Kanematsu |
| 6,908,169 | B2 | 6/2005 | Kanematsu et al. |
| 2009/0021548 | A1 | 1/2009 | Suzuki et al. |
| 2009/0040263 | A1 | 2/2009 | Tomida et al. |

FOREIGN PATENT DOCUMENTS

| | | |
|---|---|---|
| JP | 10-100398 | 4/1998 |

(Continued)

OTHER PUBLICATIONS

Office Action—Japanese Patent Application No. 2008-323733, Japanese Patent Office, mailed Nov. 20, 2012.

*Primary Examiner* — Lam S Nguyen
(74) *Attorney, Agent, or Firm* — Fitzpatrick, Cella, Harper & Scinto

(57) ABSTRACT

An object of the present invention is to provide a printing apparatus and a printing method even with a variation in the temperature of a print head, thus keeping the quality of images resulting from printing high. Adjustment patterns used to adjust the difference in ink ejection timing between ink ejected in a forward direction and ink ejected in a backward direction during scanning are printed at a plurality of different temperatures. Adjustment values for the ink ejection timing at the respective temperatures are selected from the adjustment patterns. Then, the correction value for the ink ejection timing is calculated from the adjustment values based on the temperature detected by the detection device. Printing is then performed with the difference in ink ejection timing between the ink ejected in the forward direction and the ink ejected in the backward direction during scanning, adjusted based on the correction value.

9 Claims, 15 Drawing Sheets

(56) References Cited

FOREIGN PATENT DOCUMENTS

| | | |
|---|---|---|
| JP | 11-077991 | 3/1999 |
| JP | 2000-198189 A | 7/2000 |
| JP | 2001-026101 | 1/2001 |
| JP | 2001-038930 | 2/2001 |
| JP | 2002-225238 | 8/2002 |
| JP | 2004-314361 | 11/2004 |
| JP | 2005-138323 | 6/2005 |
| JP | 2006-015678 | 1/2006 |
| JP | 2007-203491 A | 8/2007 |

| | POS1 | POS2 | POS3 | POS4 | POS5 | POS6 | ··· | POSN |
|---|---|---|---|---|---|---|---|---|
| T < 15°C | 0 | 0 | +1 | +1 | 0 | 0 | ··· | 0 |
| 15 ≦ T < 20°C | 0 | 0 | +1 | +1 | 0 | 0 | ··· | 0 |
| 20 ≦ T < 25°C | +1 | +1 | +2 | +2 | +1 | +1 | ··· | +1 |
| 25 ≦ T < 30°C | +1 | +1 | +2 | +2 | +1 | +1 | ··· | +1 |
| 70 ≦ T < 75°C | ··· | ··· | ··· | ··· | ··· | ··· | ··· | ··· |
| 75 ≦ T | +2 | +2 | +3 | +3 | +2 | +2 | ··· | +2 |

FIG.10

INK JET PRINTING APPARATUS AND PRINTING METHOD

BACKGROUND OF THE INVENTION

1. Field of the Invention

The present invention relates to an ink jet printing apparatus and an ink jet printing method which allow a print head to perform scanning for printing.

2. Description of the Related Art

An ink jet printing apparatus of the serial scan type moves the print head in a forward direction and a backward direction, while ejecting ink for printing. In this case, even with ink ejected at the same ink ejection start position, a position on a print medium impacted by ink varies between ink ejected in the forward direction scanning and ink ejected in the backward direction scanning. In bidirectional printing in which printing is performed both during the forward movement and during the backward movement to perform printing quickly, the moving direction of the print head during ink ejection is reversed between the forward movement and the backward movement. Thus, when the impact position is compared in each direction, ink ejected during the forward movement impacts the print medium away from the ink ejection start position in one direction. Ink ejected during the backward movement impacts the print medium away from the ink ejection start position in the opposite direction. Consequently, in view of this deviation, for droplets ejected at the same position, corrections need to be performed such that the ink ejected during the forward movement and the ink ejected during the backward movement impact the print medium at the same position.

In recent years, improved resolution has led to efforts to reduce the size of droplets. Thus, ink droplets ejected during a single shot are small and likely to be affected by the movement of the print head. As a result, the impact position on the print medium is likely to deviate. When the impact position of the ink droplet deviates depending on the scan direction of the print head, an image printed by the ink ejected during the forward movement of the print head fails to match an image printed by the ink ejected during the backward movement of the print head. Consequently, an undesired texture pattern may be formed in a printed image. Furthermore, the graininess of the printed image may be affected. Thus, when printing is performed, the impact positions of ejected ink droplets need to be accurately corrected.

As a technique for correcting the impact position, Japanese Patent Laid-Open No. H10-100398 (1998) proposes a printing apparatus which, before printing, adjusts the timing when a print head ejects ink, according to the scan speed of the print head and the distance between the print head and a print medium. In the printing apparatus, according to conditions set before printing, the timing for ink ejection is controllably corrected such that the ink is ejected to the desired impact position.

Furthermore, Japanese Patent Laid-Open No. 2004-314361 discloses a printing apparatus in which when a print head performs bidirectional printing, optical reading means reads a test pattern so that timings for ink ejection are adjusted according to the read information.

In the above-described printing apparatus, the correction amount for the temperature of the print head is calculated to be a preset coefficient so that a print mode and the ejection timing can be set before printing. Thus, the ink ejection timing is controlled in association with the temperature condition of the print head before printing. Consequently, ink is ejected according to the temperature of the print head measured before printing. As a result, printing can be achieved with the accuracy of the ink impact position kept high. However, the ink impact position cannot be accurately corrected in association with a variation in ejection speed or angle resulting from a variation in the temperature of the print head during printing.

SUMMARY OF THE INVENTION

Thus, in view of the above-described circumstances, an object of the present invention is to provide a printing apparatus and a printing method which keep the impact accuracy of an ejected liquid high even with a variation in the temperature of a print head during printing, thus keeping the quality of images resulting from printing high.

According to a first aspect of the present invention, there is provided an ink jet printing apparatus that performs printing by moving, in a forward direction and backward direction, a print head including ejection ports through which ink is ejected, while ejecting ink from the print head during forward movement and during backward movement, the ink jet printing apparatus comprising: temperature detecting device for detecting temperature of the print head; pattern printing device for printing patterns at a plurality of different temperatures, the patterns being used to adjust a deviation between an impact position of ink ejected during the forward movement and an impact position of ink ejected during the backward movement; acquisition device for, based on the patterns for the plurality of different temperatures, acquiring adjustment values for adjusting ink ejection timing during at least one of the forward movement and the backward movement at the plurality of different temperatures; and adjustment device for adjusting the ejection timing based on the adjustment values for the plurality of different temperatures and the temperature detected by the temperature detecting device.

According to a second aspect of the present invention, there is provided an ink jet printing apparatus that performs printing using a print head having a first ejection port row and a second ejection port row through which ink is ejected, the ink jet printing apparatus comprising: temperature detecting device for detecting temperature of the print head; pattern printing device for printing patterns at a plurality of different temperatures, the patterns being used to adjust a deviation between an impact position of ink ejected through the first ejection port row and an impact position of ink ejected through the second ejection port row; determination device for, based on the patterns for the plurality of different temperatures, determining adjustment values for adjusting ink ejection timing for at least one of the first ejection port row and the second ejection port row at the plurality of different temperatures; and adjustment device for adjusting the ejection timing based on the adjustment values for the plurality of different temperatures and the temperature detected by the temperature detecting device.

According to a third aspect of the present invention, there is provided a printing method using an ink jet printing apparatus that performs printing by moving, in a forward direction and backward direction, a print head including an ejection port through which ink is ejected, while ejecting ink from the print head during forward movement and during backward movement, the printing method comprising: a temperature detecting step of detecting temperature of the print head; a pattern printing step of printing patterns at a plurality of different temperatures, the patterns being used to adjust a deviation between an impact position of ink ejected during the forward movement and an impact position of ink ejected during the backward movement; an acquisition step of, based on the patterns for the plurality of different temperatures, acquiring adjustment values for adjusting ink ejection timing during at least one of the forward movement and the backward movement at the plurality of different temperatures; and an adjustment step of adjusting the ejection timing based on the adjustment values for the plurality of different temperatures and the temperature detected at the temperature detecting step.

According to a fourth aspect of the present invention, there is provided a printing method using an ink jet printing apparatus that performs printing using a print head having a first ejection port row and a second ejection port row through which ink is ejected, the printing method comprising: a temperature detecting step of detecting temperature of the print head; a pattern printing step of printing patterns at a plurality of different temperatures, the patterns being used to adjust a deviation between an impact position of ink ejected through the first ejection port row and an impact position of ink ejected through the second ejection port row; a determination step of, based on the patterns for the plurality of different temperatures, determining adjustment values for adjusting ink ejection timing for at least one of the first ejection port row and the second ejection port row at the plurality of different temperatures; and an adjustment step of adjusting the ejection timing based on the adjustment values for the plurality of different temperatures and the temperature detected at the temperature detecting step.

According to the present invention, the adjustment value for the liquid ejection timing is determined in association with a variation in the temperature of the print head during printing. Thus, even with a variation in the temperature of the print head, the impact accuracy of the ejected liquid during printing can be kept high. Therefore, the quality of images resulting from printing can be kept high.

Further features of the present invention will become apparent from the following description of exemplary embodiments (with reference to the attached drawings).

BRIEF DESCRIPTION OF THE DRAWINGS

FIG. 10 is a table showing, for each platen gap detection position, adjustment values for the ink ejection timing at the respective print head temperatures;

DESCRIPTION OF THE EMBODIMENTS

A printing apparatus according to a first embodiment of the present invention will be described with reference to the drawings. In embodiments described below, a printing apparatus uses an ink jet printing scheme.

(1) Description of the Printing Apparatus

Figure 11:
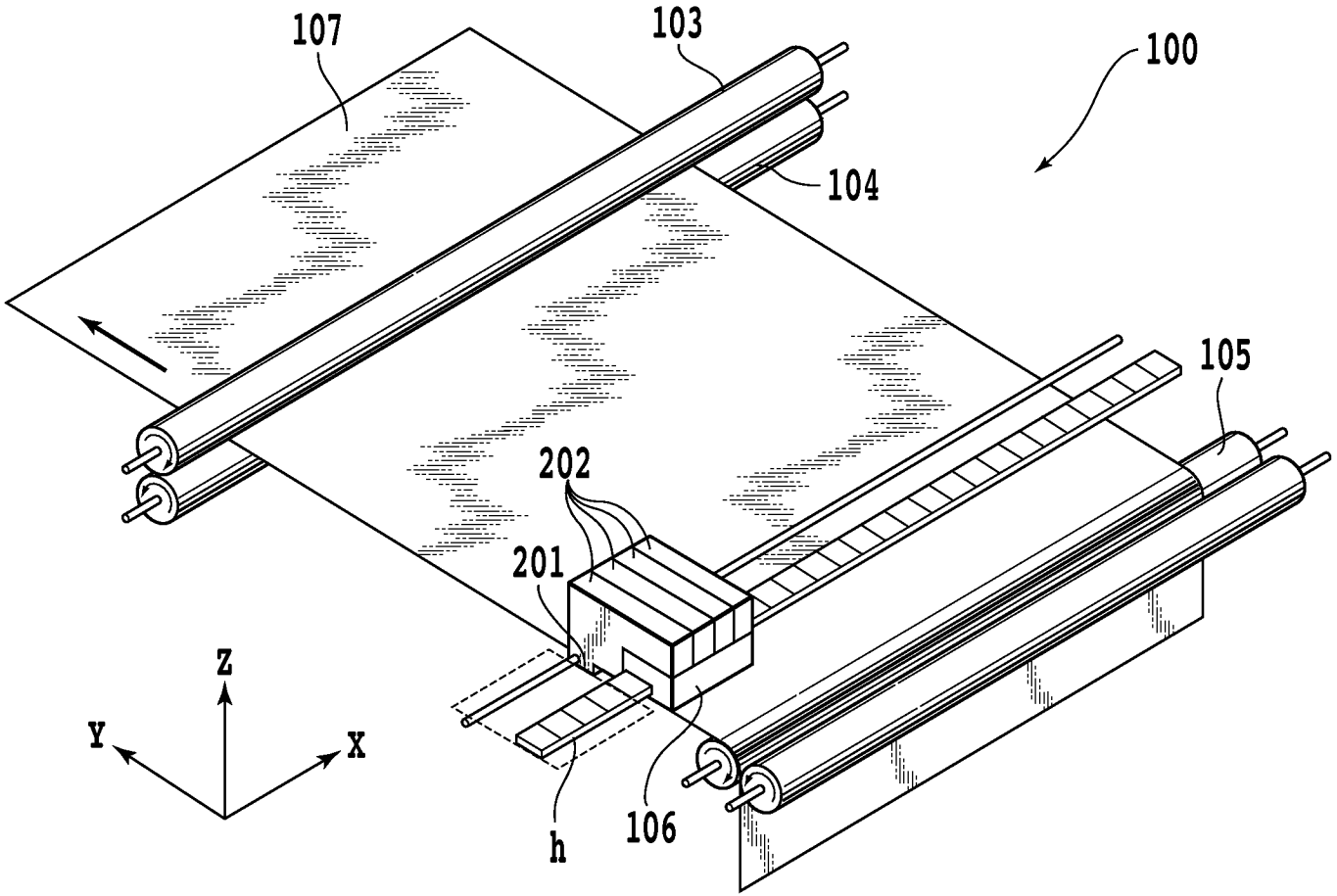
FIG. 11 is a perspective view schematically showing the essential components of an ink jet printing apparatus according to the first embodiment of the present invention.

FIG. 11 is a schematic perspective view showing the configuration of an embodiment of an ink jet print printing apparatus 100 to which the present invention is applicable. The ink jet printing apparatus 100 according to the present embodiment has a print head 201 configured to ejects ink as a liquid. The print head 201 has ejection ports through which ink is ejected, and reciprocates in a direction crossing the conveying direction of print media for scanning. The print head 201 according to the present embodiment ejects ink during both the forward and backward directions of scan for printing. Reference numeral 202 shown in FIG. 11 denotes an ink cartridge. The ink cartridge 202 according to the present embodiment has an ink tank in which ink is accommodated and the print head 201. The ink tank and the print head 201 are separably formed and installed. The printing apparatus according to the present embodiment is formed in association with ink in four colors (black, cyan, magenta, and yellow). The printing apparatus includes four ink cartridges 202 including four ink tanks arranged therein and in each of which the corresponding color ink is accommodated, and four print heads 201 corresponding to the respective ink tanks.

Reference numeral 103 denotes a conveying roller conveying a print medium 107 by rotating in the direction of an arrow shown in FIG. 11 while pressing the print medium 107 with an auxiliary roller 104. Reference numeral 106 denotes a carriage on which the four ink cartridges are mounted and supported. Furthermore, the carriage 106 allows the ink cartridges 202 and print heads 201 mounted thereon to perform scanning in a direction crossing the conveying direction during printing. The carriage 106 is controlled to standby at a home position shown by a dotted line in FIG. 11 while the printing apparatus is not perform printing and while a recovery operation is being performed on the print head.

Figure 14:
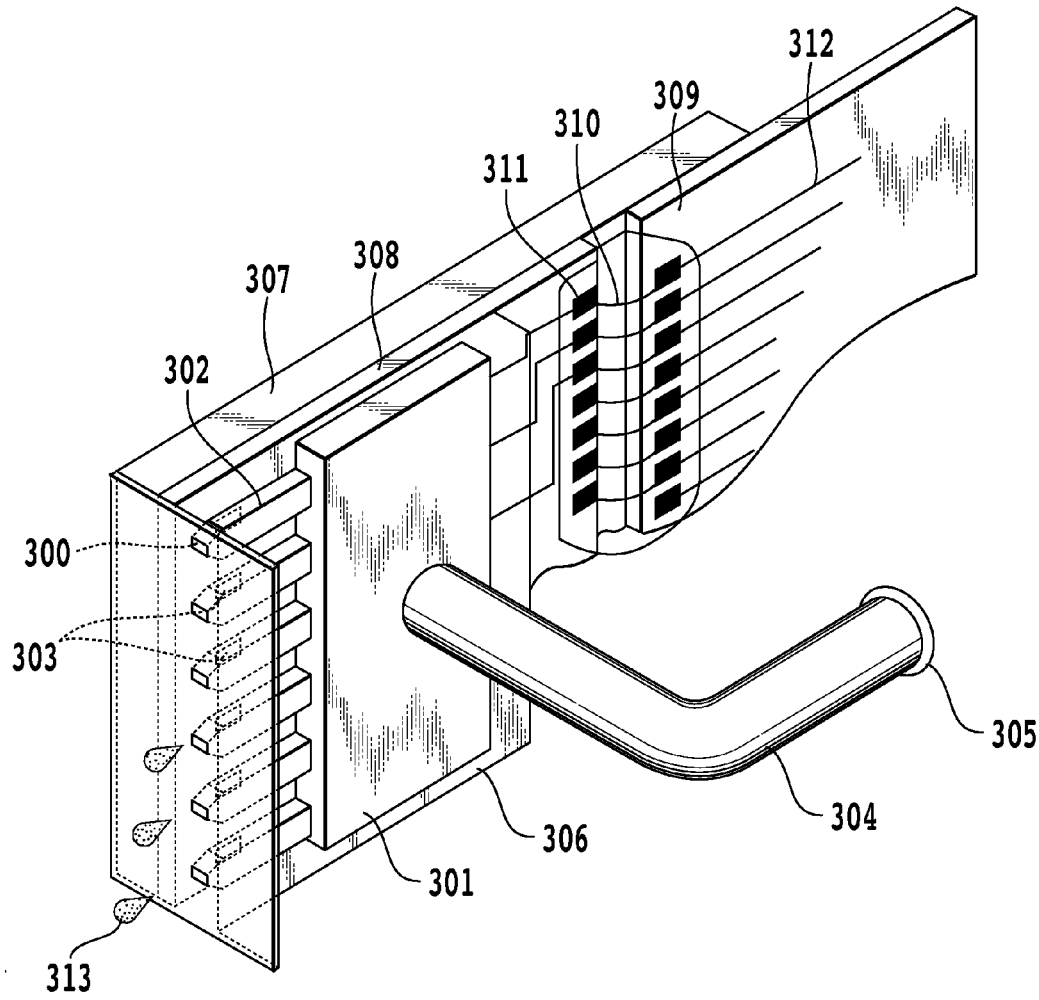
FIG. 14 is a perspective view in which the essential components of a print head mounted in the ink jet printing apparatus in FIG. 11 are shown enlarged, with a part of the print head shown exploded.

Furthermore, as described below with reference to FIG. 14, print elements 303 are formed in the print head 201 to apply motion energy to ink fed from the ink tanks so as to enable the ink to be ejected through the ejection ports in droplet form.

In the printing apparatus according to the present embodiment, before printing is started, the carriage 106 is located at the home position (h) shown by the dotted line in FIG. 11. In this state, a user issues a printing start instruction. When the printing apparatus receives the instruction, the print heads eject ink to start printing. The carriage 106 performs scanning by moving in an (x) direction shown in FIG. 11, while allowing the print elements provided in the print head 201 to be driven. Thus, an area corresponding to the print width of the print heads is printed on the print medium.

Figure 15:
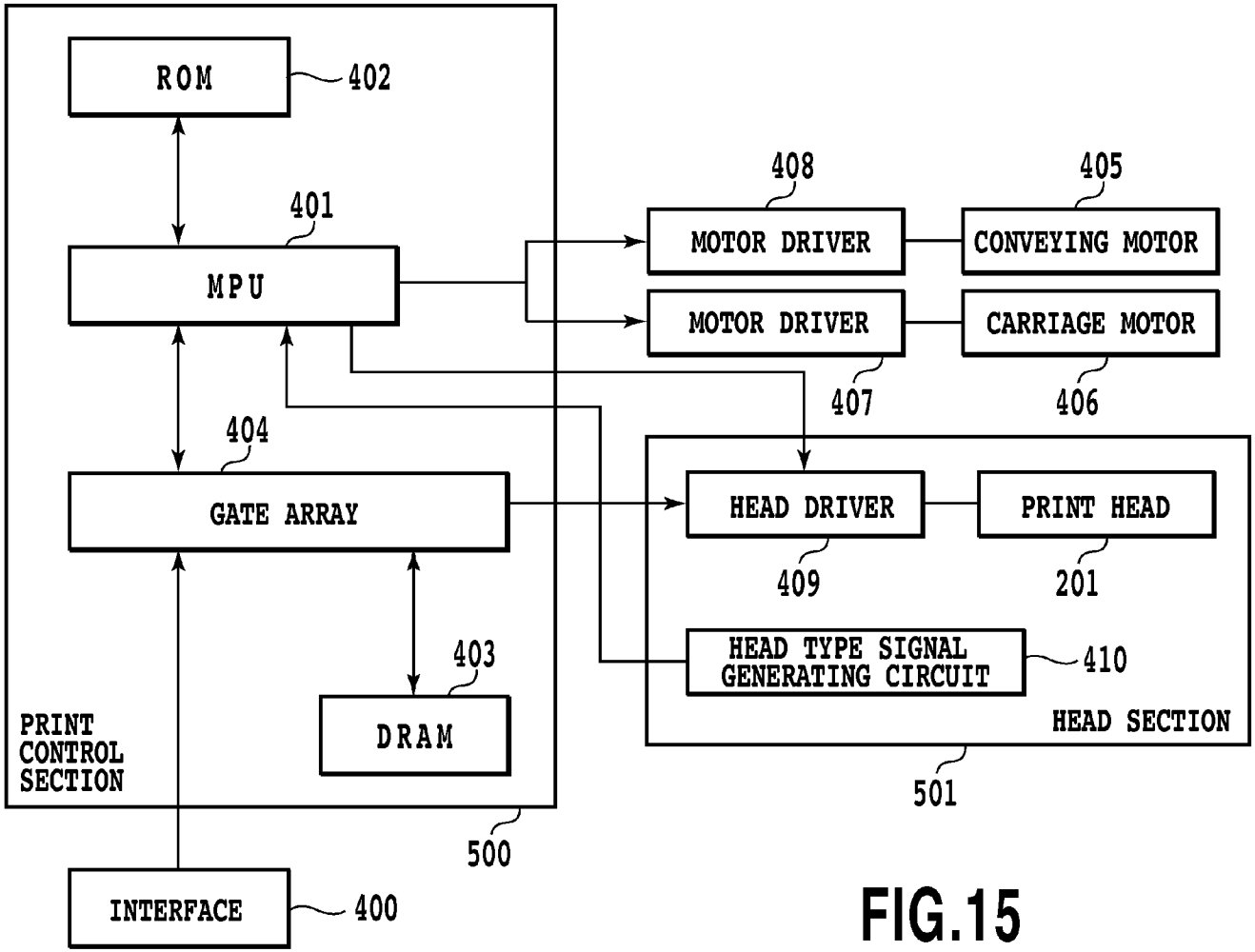
FIG. 15 is a block diagram showing a control arrangement for performing printing control on each section of the ink jet printing apparatus in FIG. 11.

When printing is performed from one end to the other end of the print medium in the width direction thereof along the scanning direction of the carriage 106, the carriage 106 returns to the home position. Then, after one scan of printing is finished and before the succeeding scan and printing is started, the conveying roller 103 rotates in the direction of the arrow shown in FIG. 11. Thus, the print medium is conveyed by a distance corresponding to the one scan of printing in a (y) direction in FIG. 11. Then, the print head 201 performs scanning again in the (x) direction to carry out the next scan of printing. In this manner, the printing apparatus prints the entire print medium by alternately repeating a main scan in which the print head 201 performs scanning in the width direction of the print medium for scanning, and conveyance of the print medium. A printing operation of ejecting ink from the print heads 201 is performed based on control provided by print control device (not shown in the drawings). The printing control is performed by an MPU shown in a block diagram described below (FIG. 15).

Furthermore, for an increased print speed, printing may be performed not only during a main scan in one direction but also while after the main scan in the (x) direction, the carriage 106 is moving in the backward direction so as to return to the home position side.

Figure 12:
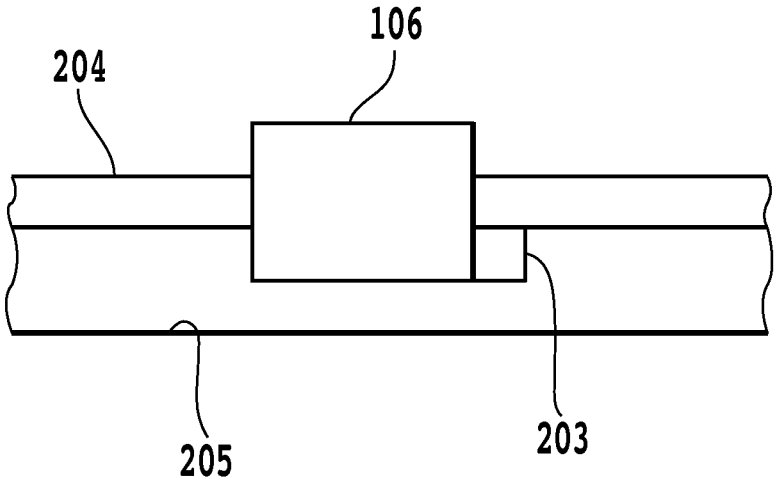
FIG. 12 is a front view showing a carriage mounted in the ink jet printing apparatus in FIG. 11, and an optical sensor attached to the carriage.

FIG. 12 is a diagram illustrating an optical sensor 203. In the ink jet printing apparatus 100 according to the present embodiment, an optical sensor 203 is provided on a side surface of the carriage 106. As described below, after a pattern for adjustment of ink ejection timings is printed on a print medium 205, the optical sensor 203 is operated in conjunction with scanning performed by the carriage 106. Thus, the printed pattern is read to detect the adjustment value. Thus, the printing apparatus 100 according to the present embodiment includes the optical sensor 203 serving as optical reading device for optically reading an adjustment pattern when the adjustment value for the ink ejection timing at one of a plurality of different temperatures is selected from adjustment patterns for the temperature. Furthermore, the optical sensor 203 detects the distance from the carriage to the print medium 205 to enable calculation of a platen gap value corresponding to the distance from the nozzle surface of the print heads to the print medium 205. Thus, the printing apparatus 100 according to the present embodiment includes the optical sensor 203 serving as platen gap detecting device capable of detecting the platen gap. The optical sensor 203 serving as the platen gap detecting device optically detects the platen gap.

Figure 13:
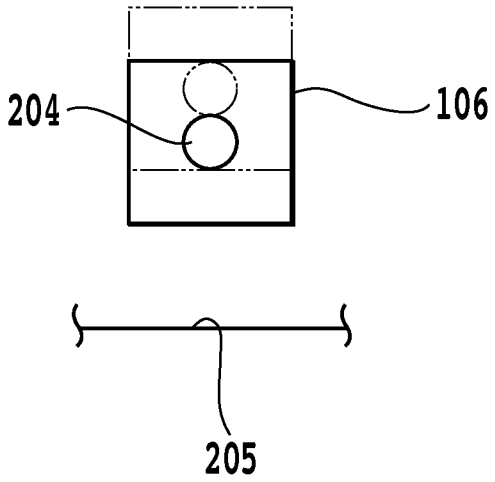
FIG. 13 is a diagram illustrating the distance between the carriage and a print medium in the inkjet printing apparatus in FIG. 11.

FIG. 13 is a diagram illustrating a mechanism configured to change the platen gap, corresponding to the distance from the print heads to the print medium. The inkjet printing apparatus 100 according to the present embodiment is formed so as to be able to move a carriage rail 204 configured to support the carriage 106, in the vertical direction. The movably formed carriage rail 204 enables the distance between the print heads 201 and the print medium to be changed. Thus, the ink jet printing apparatus 100 according to the present embodiment has platen gap changing device capable of changing the platen gap, corresponding to the distance from an ejection port formation surface of the print heads 201 to the print medium. This enables the platen gap to be adjusted according to the thickness or type of the print medium or a temperature and humidity environment. Consequently, the distance between the print heads 201 and the print medium 205 is kept optimum to prevent the print heads 201 from rubbing the print medium 205. Thus, the quality of images resulting from printing can be prevented from being degraded.

In the present embodiment, the ink jet printing apparatus 100 adopts an arrangement in which the ink tanks and the print heads are separably held on the carriage 106. However, a printing apparatus may adopt an ink jet cartridge in which ink tanks configured to accommodate printing ink are integrated with print heads ejecting ink toward the print medium 107. Alternatively, an ink tank integrated print head may be used in which ink is fed from a plurality of ink tanks to one print head and in which the plurality of ink tanks are integrally coupled to the one print head.

Furthermore, the ink jet printing apparatus 100 according to the present embodiment shown in FIG. 11 includes capping device (not shown in the drawings) for capping the ejection port formation surface of the print heads 201; the capping device is provided at the home position (h), where the above-described recovery operation is performed. Furthermore, the ink jet printing apparatus 100 according to the present embodiment includes a recovery unit (not shown in the drawings) performing a head recovery operation of, for example, removing highly viscous ink or bubbles in the print heads capped by the capping device. Additionally, a cleaning blade (not shown in the drawings) is provided around the periphery of the capping device and supported so as to be able to project toward the print heads 201. When the print heads 201 are located at the home position (h), the cleaning blade can contact with the ejection port formation surface of the print heads 201. Thus, after a recovery operation, the cleaning blade is projected to bring the ejection port formation surface into contact with the cleaning blade in the transfer pathway of the print head 201. As a result, as the print heads 201 move, unwanted ink droplets, stains, and the like are wiped off from the ejection port formation surface.

(2) Description of the Print Heads

Now, each of the print heads 201 will be described with reference to FIG. 14. FIG. 14 is a perspective view showing the essential components of the print head 201 shown in FIG. 11. As shown in FIG. 14, in the print head 201, a plurality of ejection ports 300 are formed at a predetermined pitch. Each of the ejection ports 300 is formed to communicate with a common liquid chamber 301. Print elements 303 generating energy required to eject ink are arranged along the wall surfaces of respective liquid paths 302 connecting between the common liquid chamber 301 and the corresponding ejection ports 300. Furthermore, the print head 201 has a temperature sensor (not shown in the drawings) located therein and serving as temperature detecting device for detecting temperature. The print head 201 also has temperature detecting device (not shown in the drawings) for adjusting the temperature of the print head 201. The print elements 303 and a circuit including wires, electrodes, and the like connected to the print elements are precisely formed on silicon by a semiconductor manufacturing technique. Additionally, the temperature sensor and sub-heaters (not shown in the drawings) are also formed on the same silicon at a time by a process similar to the semiconductor manufacturing process.

A silicon plate 308 including the circuit with the electric wires and the like is bonded to an aluminum base plate 307 for heat radiation. Furthermore, a circuit connection section 311 and a circuit print board 309 both arranged on the silicon plate 308 are connected together by ultra-thin wires 310. A signal circuit 312 is formed on the circuit print board 309 to transmit signals from a printing apparatus main body. Thus, signals from the printing apparatus are transmitted to the circuit on the silicon plate through the signal circuit 312. The signals are then transmitted to the print elements 303.

The liquid paths 302 and the common liquid chamber 301 are composed of a plastic cover 306 formed by injection molding. The common liquid chamber 301 is connected to the corresponding above-described ink tank via a joint pipe 309 and an ink filter 305. Ink is fed from the ink tank to the common liquid chamber 301, in which the ink is temporarily stored. The ink then enters the liquid paths 302 owing to a capillary phenomenon. The ink then forms meniscus at the ejection ports 300 to keep the liquid paths 302 full. In this state, the print elements 303 are energized via electrodes (not shown in the drawings) to generate heat. The ink on the print elements 303 is then heated rapidly to generate bubbles in the liquid paths 302. The bubbles are expanded to eject ink droplets 313 through the ejection ports 300.

(3) Description of the Control Arrangement

Now, a control arrangement for performing printing control on each section of the apparatus configuration will be described with reference to the block diagram shown in FIG. 15. In FIG. 15 showing a control circuit, reference numeral 400 denotes an interface via which print signals are input. Reference numerals 901 and 402 denote an MPU and a program ROM in which control programs executed by the MPU 401 are stored. Furthermore, reference numeral 903 is a dynamic RAM (DRAM) to which various data (the print signals, print data to be supplied to the heads, and the like) are saved. The DRAM can store the numbers of print dots, the numbers of replacements of the print heads, and the like. Reference numeral 404 denotes a gate array controlling the supply of print data to the print heads. The gate array also controls transfers between the interface 400 and the MPU 401 and the DRAM 403. Reference numeral 405 is a conveying motor (LE motor) configured to convey the print medium. Reference numeral 406 denotes a carriage motor (CR motor) configured to convey the print heads. Reference numerals 407 and 408 denote motor drivers configured to drive the conveying motor 405 and the carriage motor 406, respectively. Reference numeral 409 denotes a head driver configured to drive the print heads 201.

(Characteristic Configuration of the First Embodiment)

The essential components of the present embodiment will be described below.

In the present embodiment, first, adjustment patterns are formed at two different temperatures of the print head. The optimum pattern is then selected and used to calculate a correction value. Then, for the other temperatures of the print head, such correction values as provide the optimum patterns are calculated by linear interpolation. Based on these correction values, timings when ink is ejected from the print head 201 are corrected and adjusted. In this manner, the ink ejection timing is corrected in association with a variation in temperature. The impact accuracy of ejected ink is thus kept high. The steps of adjusting the timing for ink ejection from the print head 201 according to the present embodiment will be described below in detail.

Figure 1:
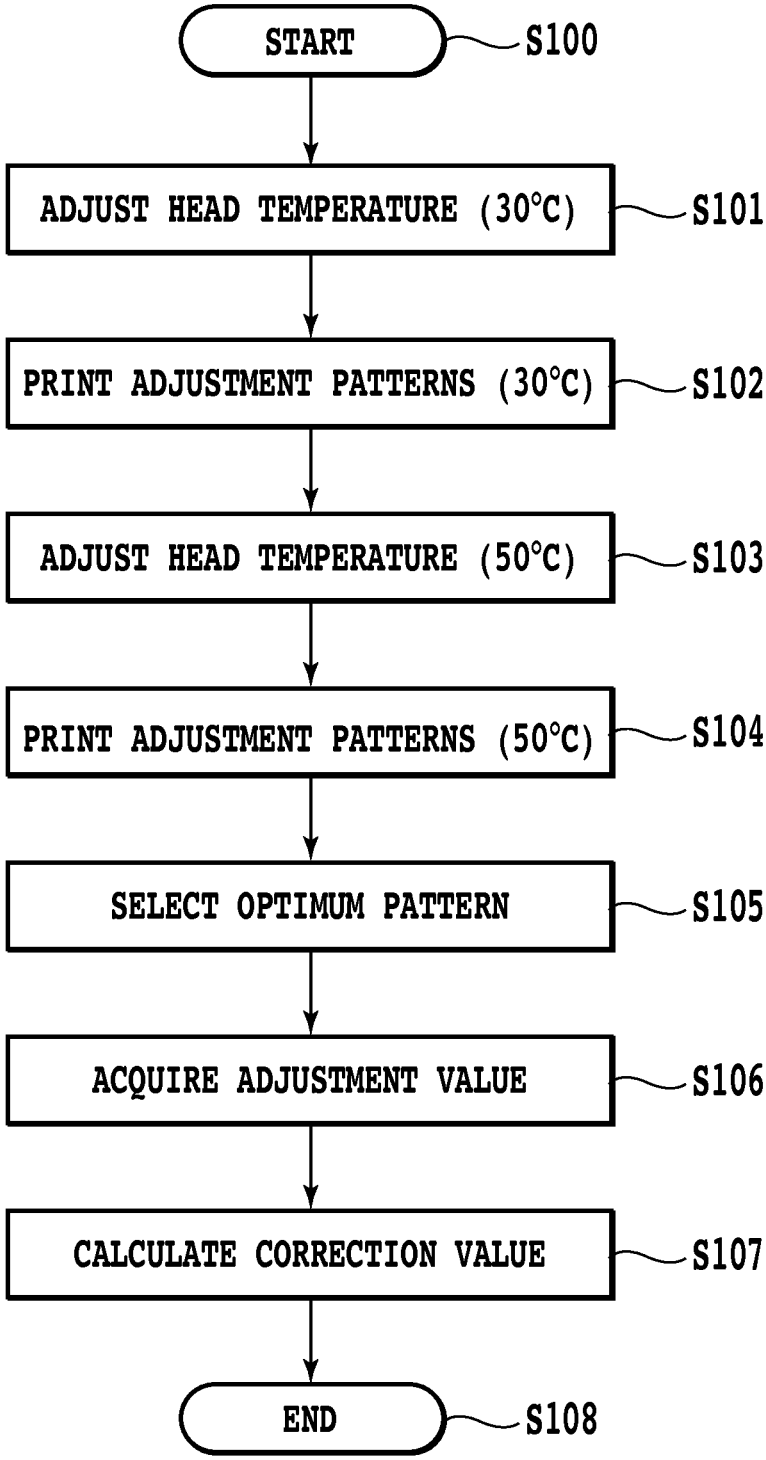
FIG. 1 is a flowchart showing a flow from formation of an adjustment pattern until calculation of the correction value in a printing method according to a first embodiment of the present invention.
Figure 2A:
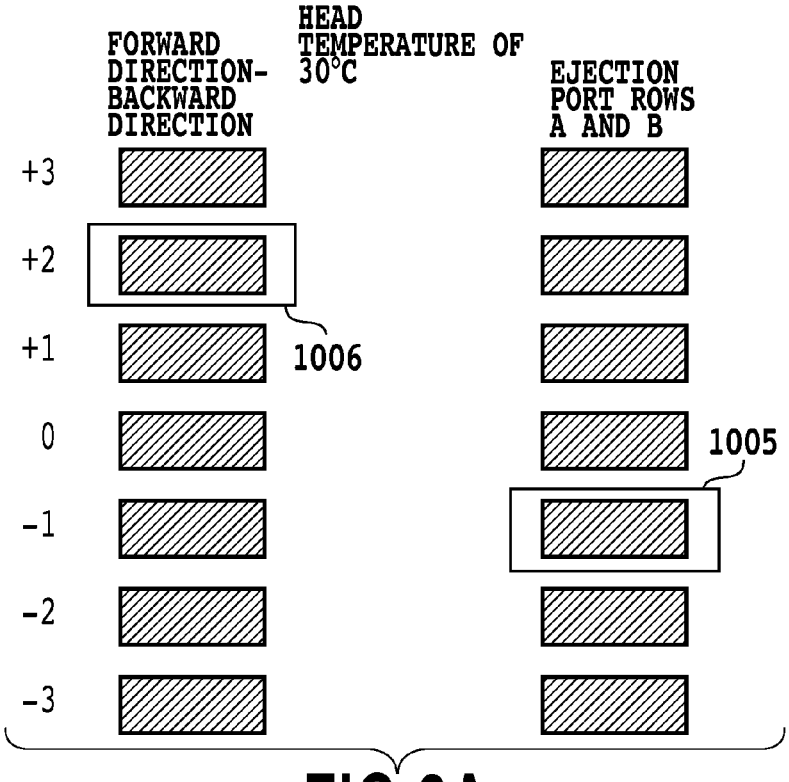
FIG. 2A is a view of an adjustment pattern used to adjust an ink ejection timing when the temperature of a print head is 30° C. according to the first embodiment.
Figure 2C:
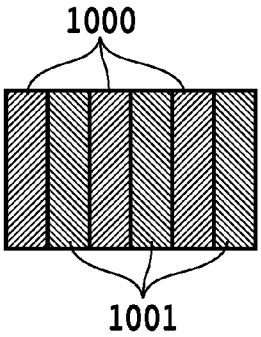
FIGS. 2C and 2D are enlarged view of adjustment patterns according to the first embodiment.
Figure 2B:
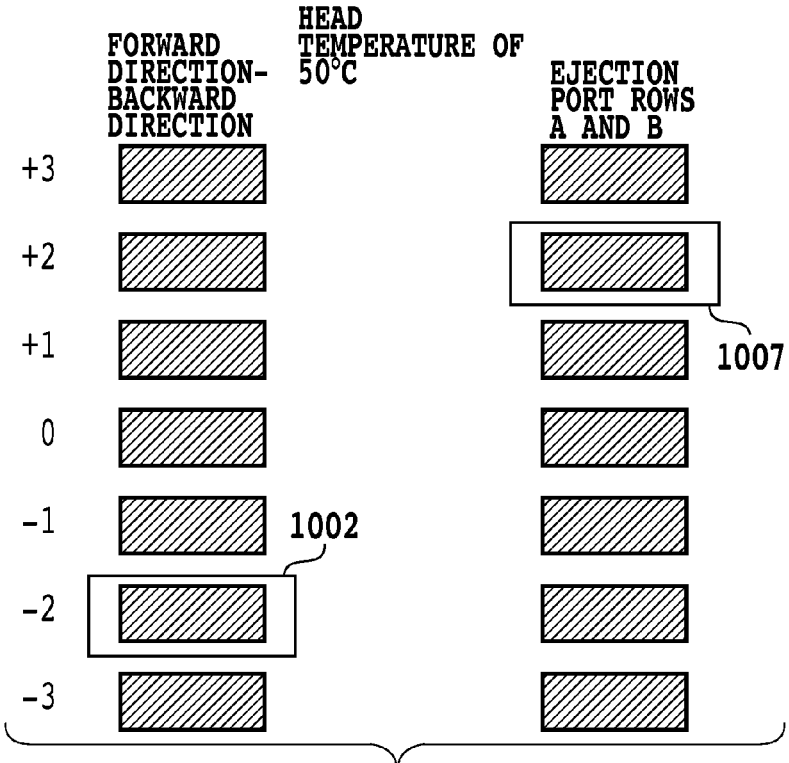
FIG. 2B is a view of an adjustment pattern used to adjust an ink ejection timing when the temperature of the print head is 50° C. according to the first embodiment.
Figure 2D:
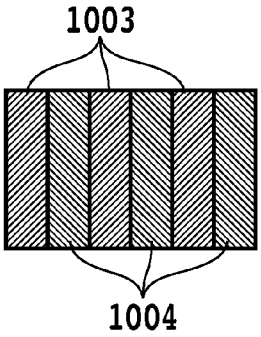

FIG. 1 is a flow chart of printing of an adjustment pattern according to the present embodiment. FIG. 2A shows adjustment patterns formed to adjust the ink ejection timing when the print head 201 is at 30° C. FIG. 2B shows adjustment patterns formed to adjust the ink ejection timing when the print head 201 is at 50° C. FIGS. 2C and 2D are enlarged views of ones of the plurality of adjustment patterns shown in FIGS. 2A and 2B.

First, the temperature of the print head 201 is adjustably set to 30° C. (S101). The print head maintained at 30° C. ejects ink to form adjustment patterns.

In this case, first, during a scan in the forward direction, the print head 201 prints a plurality of forward adjustment patterns 1000. Then, during a scan in the backward direction, the print head 201 prints a plurality of backward adjustment patterns 1001. Here, the printing by the print head 201 is such that the ejection timing varies between the printing of the forward adjustment patterns 1000 and the printing of the backward adjustment patterns 1001.

In this case, in the present embodiment, the difference in ejection timing is set so as to be divided into seven stages. In order to allow ink to be ejected at ejection timings suitable for relevant conditions, seven types of ejection timing patterns are formed for the respective stages of timing. Then, the optimum one of the seven types of adjustment patterns is selected in which the patterns are evenly arranged so as to avoid overlapping one another and forming a gap between the adjacent patterns. The user then selects the adjustment value for the optimum pattern. In this manner, the optimum one of the plurality of adjustment patterns can be selected. In the present embodiment, an adjustment pattern is formed such that the difference in ink ejection timing between ink ejected in the forward direction and ink ejected in the backward direction corresponds to +3, included in the seven set stages. Subsequently, the difference in ejection timing is varied stepwise from +2 through +1, 0, −1, and −2 to −3, with adjustment patterns printed (S102). The forward adjustment patterns 1000 and the backward adjustment patterns 1001 are desirably such that when the patterns are formed with the ejection timing varied, the overlapping of the patterns is easily detected as a variation in density. Alternatively, a ruled line may be used to be detected as misalignment of the ruled line. Furthermore, in the present embodiment, the difference in ink ejection timing is set to be divided into seven stages, for each of which an adjustment pattern is formed. However, the present invention is not limited to this aspect. The difference in ink ejection timing may be set so as to be divided into more or less than seven stages.

Then, the temperature of the print head 201 is adjustably set to 50° C. (S103). A plurality of adjustment patters are printed (S104) as is the case with printing of adjustment patterns at a head temperature 30° C. In this manner, the adjustment patterns for adjusting the difference in the ink ejection timing, as a liquid ejection timing, between the ink ejected in the forward direction and the ink ejected in the backward direction are printed at a plurality of different temperatures (adjustment pattern printing step). Then, the optimum one of the plurality of adjustment patterns is selected in which the patterns are evenly arranged so as to avoid overlapping one another and forming a gap between the adjacent patterns. The user then selects the adjustment value for the optimum pattern (S105). The adjustment value for the ink ejection timing, as a liquid ejection timing, at each of the plurality of different temperatures is selected from the adjustment patterns for the temperature (adjustment value selecting step). In the present embodiment, an adjustment value of +2 is acquired for the optimum pattern 1006 between the forward and backward directions at a head temperature of 30° C. An adjustment value of −2 is acquired for the optimum pattern 1002 based on the difference in ejection timing between the forward and backward directions at a head temperature of 50° C. (S106). A correction value is calculated based on the selected adjustment values (S107). Thus, the correction value for the ink ejection timing is calculated from the adjustment values selected in the adjustment value selecting step based on the temperature detected by the temperature sensor, serving as the temperature detecting device (correction value calculating step). In the present embodiment, to calculate the correction value for the ink ejection timing, linear interpolation is carried out based on the plurality of temperature adjustment values and the detected temperature.

Furthermore, in addition to the adjustment of the ink ejection timing between the forward and backward directions for a variation in temperature during printing, pattern adjustment may be performed between two different ejection port rows. FIG. 23 is an enlarged view of one of the adjustment patterns formed by allowing ink to be ejected through different ejection port rows such as the ejection port rows A and B. In this case, in the present embodiment, for one set temperature, the difference in ink ejection timing is adjusted between an ejection port row A pattern formed by ink ejected through an ejection port row A and an ejection port row B pattern formed by ink ejected through an ejection port row B. At this time, as shown in FIG. 2D, patterns are alternately formed by ink 1003 ejected through the ejection port row A and ink 1004 ejected through the ejection port row B. In this manner, ejection port row adjustment patterns used to adjust the difference in the timing for the ink ejection through the plurality of different ejection port rows are printed at a plurality of different temperatures. Thus, a plurality of patterns are formed as shown in FIGS. 2A and 2B. Then, the optimum one of the plurality of adjustment patterns is selected in which the patterns are evenly arranged so as to avoid overlapping one another and forming a gap between the adjacent patterns. That is, adjustment values for the ink ejection timing at each of the temperatures are selected from the ejection port row adjustment patterns obtained at the plurality of different temperatures. The correction value for the ink ejection timing is then calculated from the selected adjustment values based on the temperature detected by the temperature detecting device.

In the present embodiment, an adjustment value of −1 is acquired for the optimum pattern 1005 based on the difference in ink ejection timing between the ejection port rows A and B at a head temperature of 30° C. An adjustment value of +2 is acquired for the optimum pattern 1007 based on the difference in ejection timing between the ejection port rows A and B at a head temperature of 50° C.

As described above, one of the adjustment patterns formed through the ejection port rows A and B is selected and used to adjust the ink ejection timing for the ink ejected through each of the ejection port rows. The ejection port row A pattern 1003 and the ejection port row B pattern 1004 are desirably such that when the patterns are formed with the ejection timing varied, the overlapping of the patterns is easily detected as a variation in density. Furthermore, alternatively, even the ejection port row A pattern 1003 and the ejection port row B pattern 1004, a ruled line may also be used to be detected as misalignment of the ruled line.

Figure 3A:
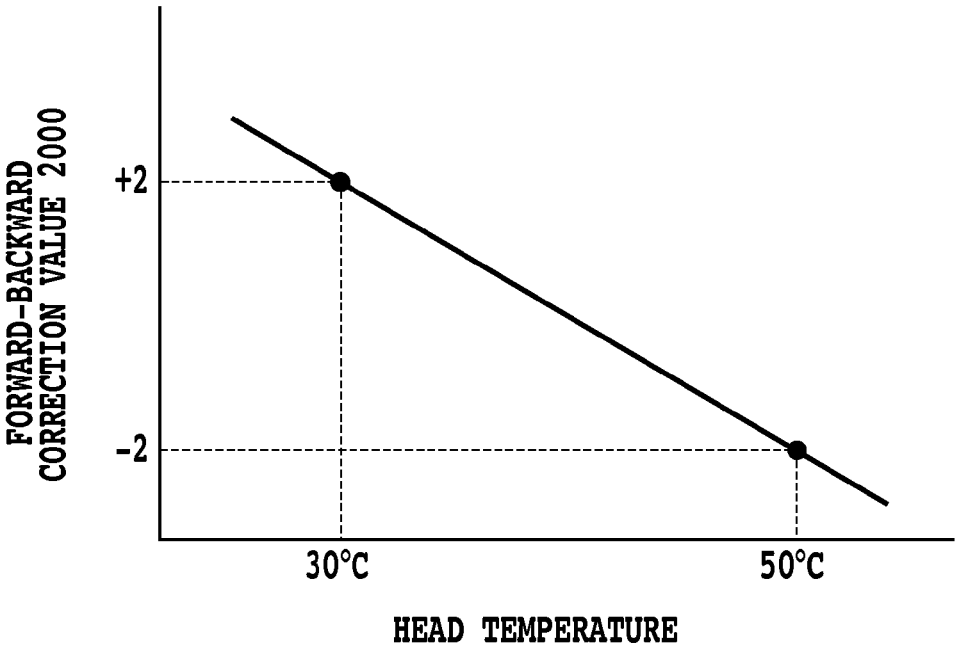
FIG. 3A is a graph showing a plot of adjustment values for the ink ejection timing in connection with the forward direction and backward direction of scan which values are measured when the print head temperature is 30° C. and 50° C. according to the first embodiment.
Figure 3B:
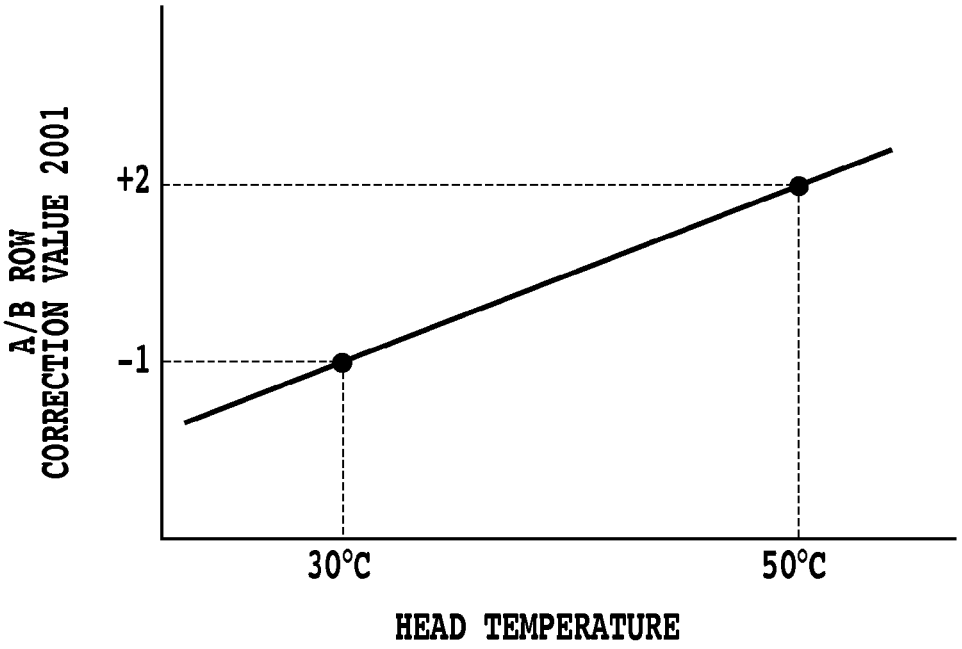
FIG. 3B is a graph showing a plot of adjustment values for the ink ejection timing in connection with different ejection port rows.

FIG. 3A is a graph showing correction values calculated from values measured when the print head according to the present embodiment is 30° C. and 50° C., based on the difference in ink ejection timing between the ink ejected in the forward direction and the ink ejected in the backward direction. Furthermore, FIG. 3B is a graph showing correction values calculated from values measured when the print head according to the present embodiment is 30° C. and 50° C., based on the difference in ink ejection timing between the ink ejected through the ejection port row A and the ink ejected through the ejection port row B. Thus, by linearly interpolating the correction values in the graphs shown in FIGS. 3A and 3B, correction values based on the difference in ink ejection timing can be calculated based on measured values of the temperature of the print head other than 30° C. and 50° C.

In the present embodiment, the correction value based on the temperature of the print head is calculated by linearly interpolating the correction values based on the values measured at the two different temperatures. However, a table may be used which corresponds to temperature classification of print head. The following method is also possible: adjustment patterns are formed at three or more different print head temperatures, the difference in ejection timing which is optimum at each of the temperatures is selected to determine the correction value, and the resulting correction values are interpolated using an approximate expression to calculate the correction value.

Figure 4:
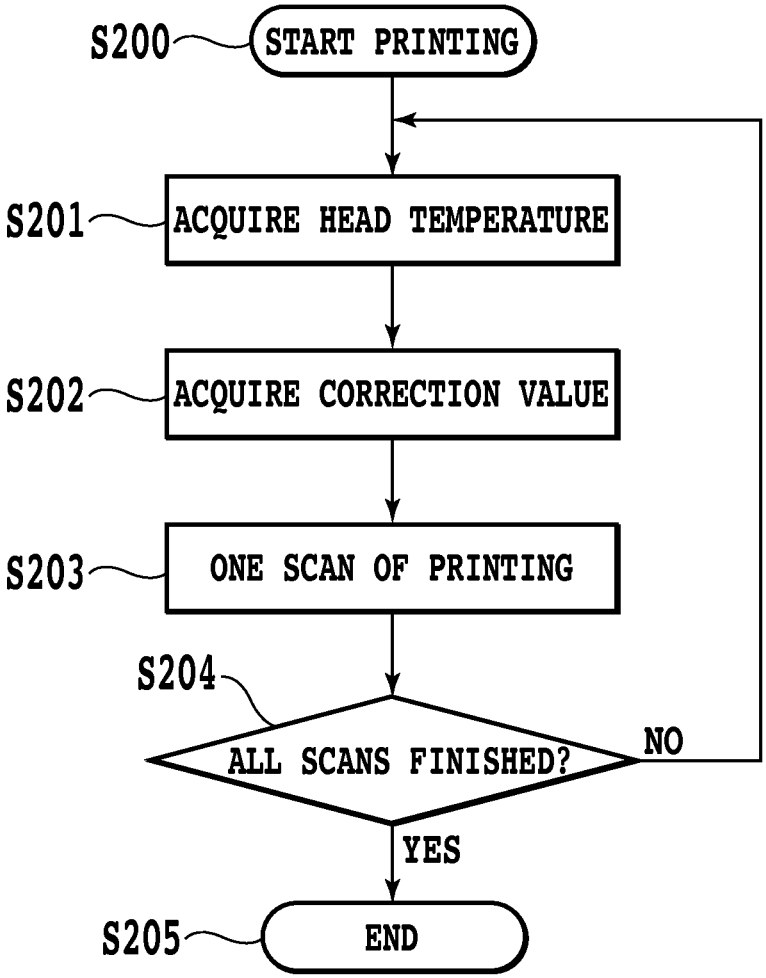
FIG. 4 is a flowchart showing the flow of printing of a predetermined area on a print medium using a printing method according to the first embodiment.

FIG. 4 is a flowchart of printing of a predetermined area on a print medium using the method of adjusting the ink ejection timing in the printing apparatus according to the present invention. In the present embodiment, the entire sheet of the print medium is printed. First, at the beginning of scanning, the temperature sensor attached to the print head measures and acquires the temperature of the print head (S201). Then, the correction value for the difference in ink ejection timing between the forward and backward directions according to the temperature of the print head is calculated and acquired (S202). At this time, according to the difference in ink ejection timing between different ejection port rows such as the ejection port rows A and B, the correction value for the difference in ejection timing between the ink ejected through one of the ejection port rows and the ink ejected through the other ejection port row is calculated and acquired.

Then, according to the correction value acquired, an ejection start timing is corrected. Then, one scan of printing is performed (S203). Thus, printing is performed with the difference in ink ejection timing between the ink ejected in the forward direction and the ink ejected in the backward direction during scanning, adjusted based on the correction value acquired (ejection timing adjusting step). The process then determines whether or not all the scans required for the predetermined print area have been finished (S204). When one scan of printing is performed, the print medium is conveyed by the corresponding print width. Then, the print head starts scanning again to perform the next scan of printing. When the next scan of printing is started, the temperature sensor detects the print head temperature again. Then, based on the detected temperature, adjustment is made of the difference in ink ejection timing between the ink ejected in the forward direction and the ink ejected in the backward direction during scanning. A similar process is repeated until the printing of the predetermined print area on the print medium is finished. In the present embodiment, the printing is finished when the print medium has been entirely printed.

According to the present embodiment, printing is performed as described above. Every time one scan of printing is carried out, the temperature of the print head is measured, and based on the measured temperature, the ink ejection timing is adjusted. Thus, the ink ejection timing is adjusted for each scan in association with a variation in temperature during a printing operation. Therefore, the quality of images resulting from printing is kept high.

As described above, adjustment patterns are printed at different head temperatures, and adjustment values are determined. A correction value is then calculated in association with the head temperature. Thus, printing can be performed with a reduction in the formation of texture patterns and the degradation of graininess both resulting from impact deviation caused by a variation in head temperature.

(Second Embodiment)

Now, a second embodiment for carrying out the present invention will be described. Components of the second embodiment which are similar to those of the above-described first embodiment will not be described below. Only differences from the first embodiment will be described.

In the above-described first embodiment, during a printing operation, the temperature of the print head is measured for every scan of printing. The ink ejection timing is adjusted based on the temperature. In contrast, in the present embodiment, the correction value is also updated according to a variation in temperature during a single scan so as to prevent a possible reduction in impact accuracy caused by a variation in print head temperature during scanning.

Figure 5A:
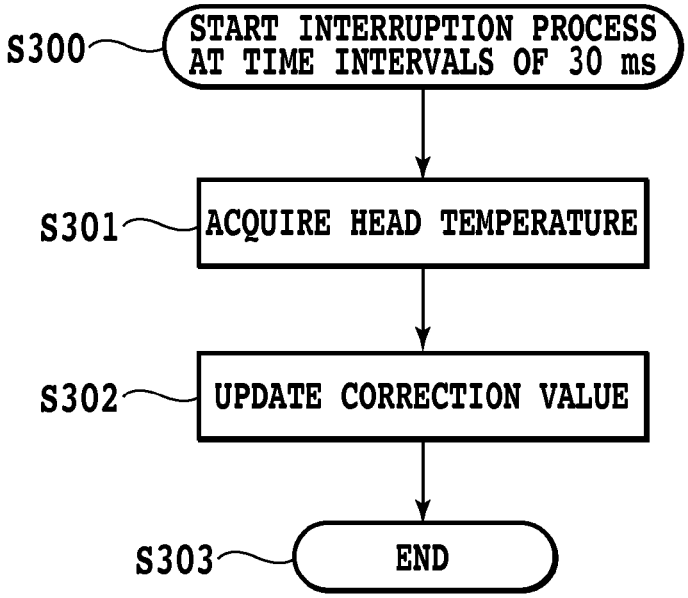
FIG. 5A is a flowchart showing the flow of a printing method according to a second embodiment of the present invention in which an interruption process is started every predetermined time during printing.
Figure 5B:
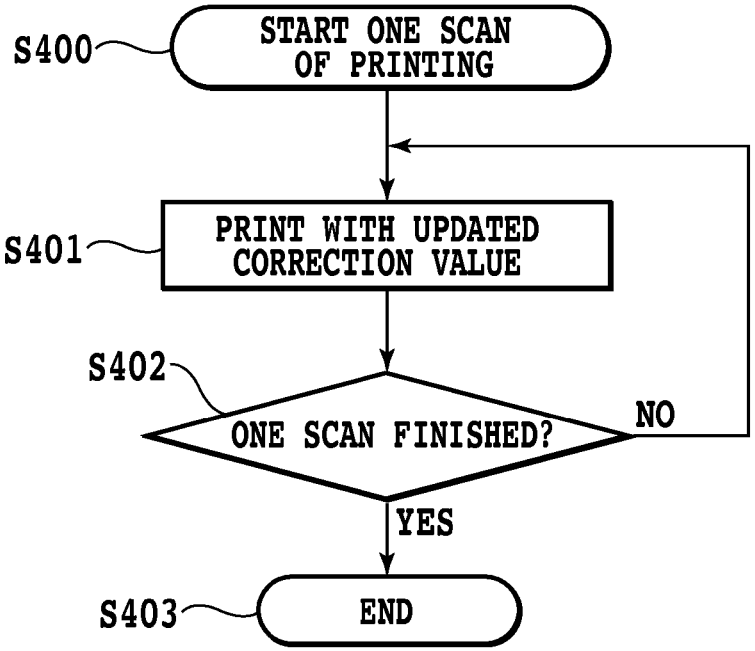
FIG. 5B is a flowchart showing a flow until one scan of printing is carried out.

FIGS. 5A and 5B are flowcharts of a printing method used for printing according the present embodiment. Here, it is assumed that patterns have already been selected according to the differences in ejection timing at a plurality of different print head temperatures and that data corresponding to the graph in FIG. 3A has already been acquired.

In the present embodiment, as shown in FIG. 5A, as an interruption process (S300) executed at time intervals of 30 ms during a printing operation, the temperature of the print head is detected and acquired (S301). Thus, a temperature sensor serving as temperature detecting device detects the temperature of the print head at the predetermined time intervals. Subsequently, based on the print head temperature acquired, a correction value is calculated for updating (S302). At this time, in the present embodiment, based on the print head temperature acquired, a correction value is calculated by linear interpolation using pre-acquired data on the ejection timings at a plurality of print head temperatures as shown in the graph in FIG. 3A. In this manner, the correction value for the ink ejection timing is calculated, at the predetermined time intervals, from the pre-acquired adjustment values based on the temperature detected by the temperature sensor. Here, the interruption process is executed at time intervals of 30 ms. However, the optimum time intervals corresponding to the system may be used.

Then, printing is performed with the ejection start timing during a single scan switched as required based on the correction value updated as a result of the interruption process (S401). Then, as shown in FIG. 5B, the process determines whether or not the one scan printing has been finished (S402). If the scan printing has not been finished, the process is repeated.

As described above, a possible reduction in impact accuracy caused by a variation in head temperature during a single scan can be prevented by updating the correction value every predetermined time according to a variation in temperature during a single scan. Thus, the correction value for the ink ejection timing is updated every predetermined time. Therefore, the ink ejection timing is more frequency adjusted, allowing the ink impact accuracy to kept high.

(Third Embodiment)

Now, a third embodiment for carrying out the present invention will be described. Components of the third embodiment which are similar to those of the above-described first and second embodiments will not be described below. Only differences from the first and second embodiments will be described.

In the above-described first and second embodiments, the platen gap, corresponding to the distance between the print head and the print medium, is constant. In contrast, in the present embodiment, even with a variation in the distance between the print head and the print medium during printing, the ink ejection timing is adjusted accordingly. Thus, the impact accuracy of ejected ink can be kept high.

In the present embodiment, for each of two different platen gaps, patterns are selected at two different print head temperatures. Then, the correction value for the ink ejection timing is selected. Then, during a printing operation, linearity correction is performed in terms of both the platen gap and the print head temperature. Thus, printing is performed using the correction value corresponding to the platen gap and the print head temperature.

Figure 6:
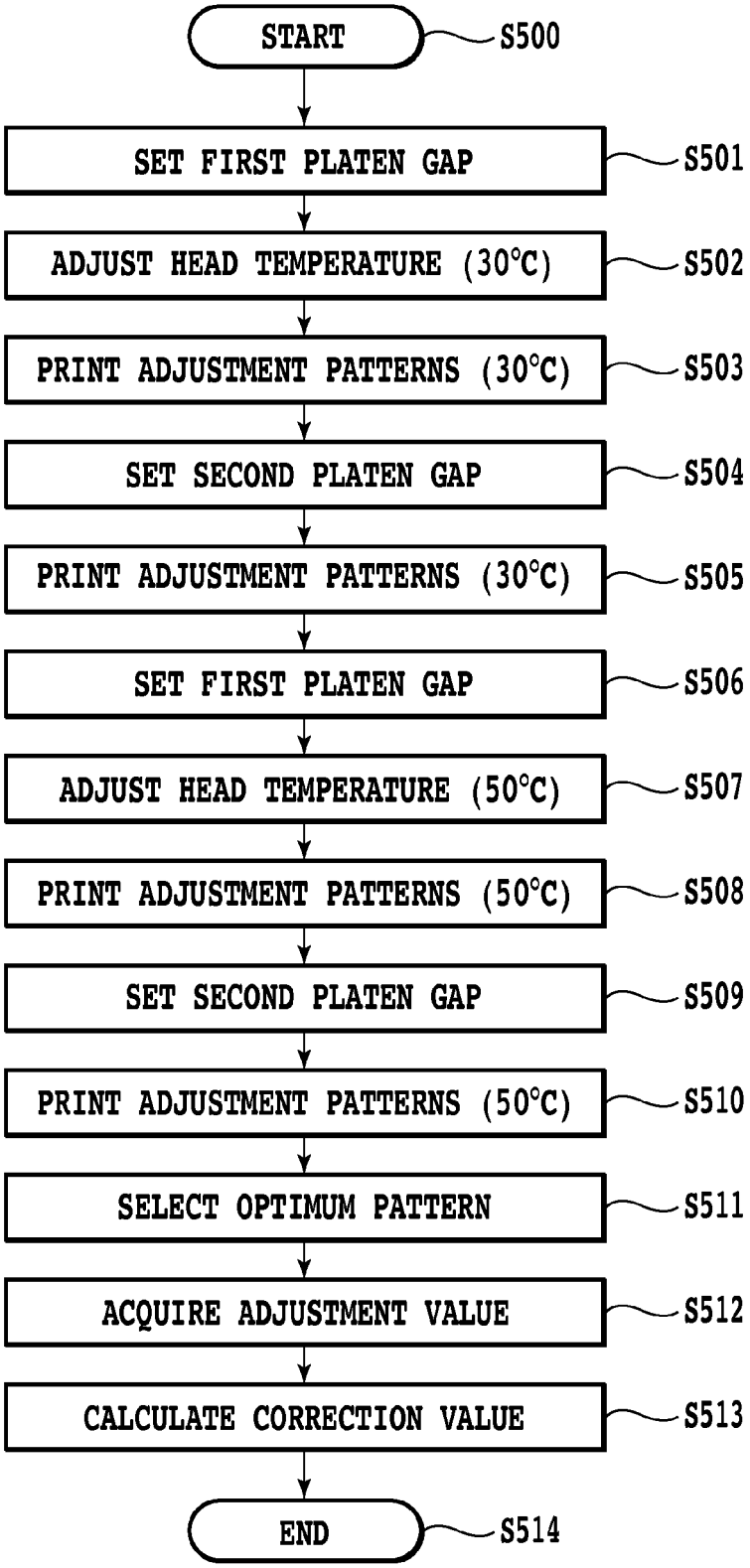
FIG. 6 is a flowchart showing a flow from formation of an adjustment pattern until calculation of the correction value in a printing method according to a third embodiment of the present invention.

A method for preventing a possible decease in impact accuracy caused by the platen gap and a variation in head temperature will be described below. FIG. 6 is a flowchart of printing of adjustment patterns according to the present embodiment. First, the distance between the print head and the print medium is set equal to a first platen gap (S501). Subsequently, the temperature of the print head is adjusted to 30° C. (S502). Here, as is the case with the above-described first and second embodiments, a plurality of adjustment patterns are printed with the ejection timing varied (S503). Then, the optimum adjustment pattern is selected, and the adjustment value for the ejection timing is selected.

Then, the distance between the print head and the print medium is set equal to a second platen gap (S504). In this state, the print head is set to 30° C., and a plurality of adjustment patterns are printed (S505). Then, the adjustment value for the ejection timing which is optimum for this condition is selected from the plurality of adjustment patterns printed.

Subsequently, the distance is set equal to the first platen gap (S506). The temperature of the print head is adjusted to 50° C. (S507). Adjustment patterns are printed with the ejection timing varied (S508). Then, the distance is set equal to the second platen gap (S509). Adjustment patterns are printed with the temperature of the print head set to 50° C. (S510). The user selects the adjustment value for an apparently optimum one of the adjustment patterns to be the optimum value (S511). The adjustment value for the optimum pattern is acquired (S512). The correction value described below is calculated from the adjustment value (S513). In this manner, a plurality of platen gaps are set, and for each of the plurality of platen gaps, adjustment patterns allowing adjustment of the difference in ink ejection timing between the ink ejected in the forward direction during scanning and the ink ejected in the backward direction during scanning are printed at a plurality of different temperatures.

Figure 7A:
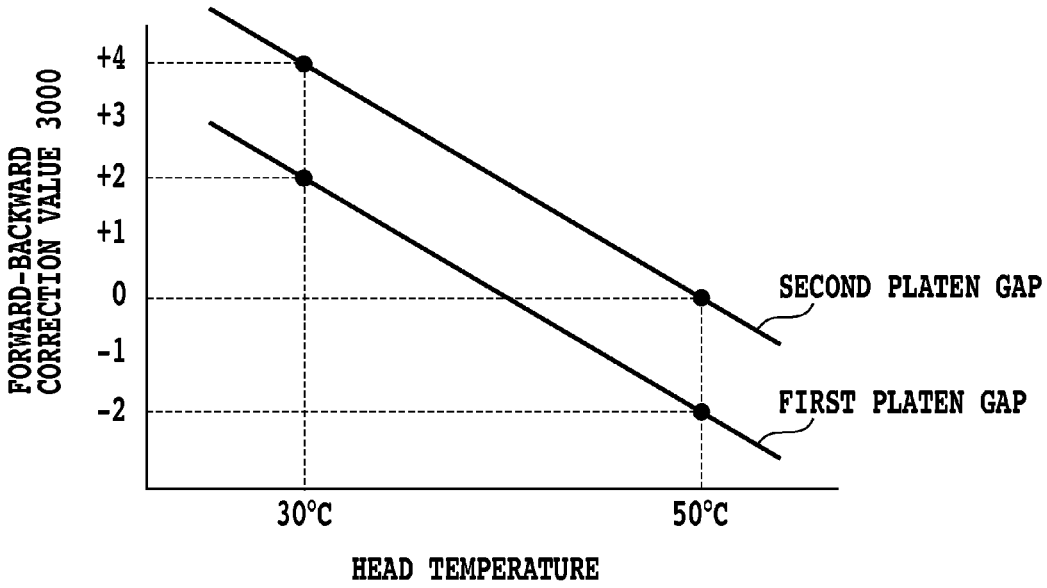
FIG. 7A is a graph showing a plot, for different platen gaps, of adjustment values for the ink ejection timing measured when the print head temperature is 30° C. and 50° C. according to the third embodiment.

FIG. 7A is a graph showing correction values relating to the forward and backward directions for each of the first and second platen gaps. Each of the correction value based on the head temperature is calculated by linearly interpolating the correction values for a head temperature of 30° C. and a head temperature of 50° C. Thus, since the adjustment value for the ejection timing is selected from those for a plurality of different platen gaps, linear interpolation can be performed on the platen gap. In the present embodiment, the correction value based on the platen gap can be obtained by interpolating the values for the first and second platen gaps. In this manner, the adjustment value for the ink ejection timing at each of a plurality of different temperatures is selected from the adjustment patterns at the plurality of different temperatures for each of a plurality of platen gaps. Then, the correction value for the ejection timing is calculated from the selected adjustment value based on the temperature detected by the temperature detecting device and the platen gap. Printing is then performed with the difference in ejection timing between the ink ejected in the forward direction and the ink ejected in the backward direction during scanning, adjusted based on the correction value acquired. In the present embodiment, each of the platen gaps is detected by an optical sensor 203 serving as platen gap detecting device.

Figure 7B:
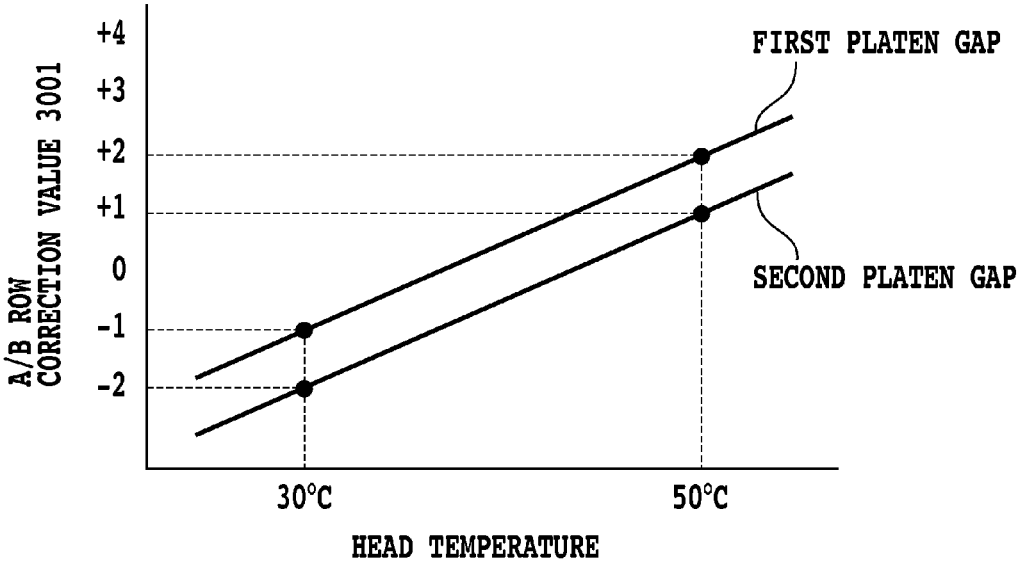
FIG. 7B is a graph showing a plot, for different platen gaps, of adjustment values for the ink ejection timing in connection with different ejection port rows according to the third embodiment.

As shown in FIG. 7B, the present embodiment may be used not only to adjust the ejection timing between the forward and backward directions but also to adjust the ejection timing between different ejection port rows such as the ejection port rows A and B.

In the present embodiment, the graphs shown in FIGS. 7A and 7B are used to calculate the correction value. However, a table based on heat temperature classifications may be used or pattern adjustment may be performed at three or more head temperatures. Alternatively, interpolation using approximate expression may be carried out.

Figure 8:
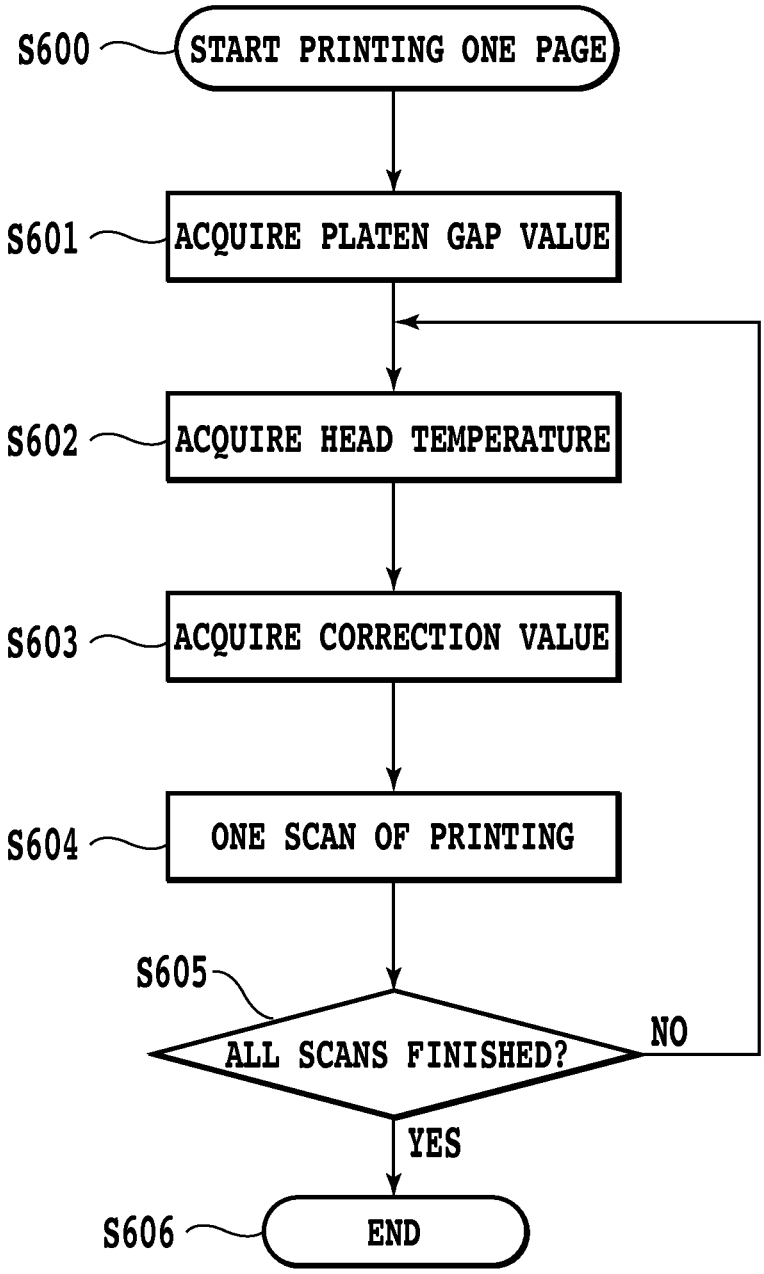
FIG. 8 is a flowchart showing the flow of printing of a predetermined area on a print medium using a printing method according to the third embodiment.

FIG. 8 is a flowchart of printing of a predetermined area on a print medium according to the present embodiment. First, at the beginning of printing, the platen gap value corresponding to the distance between the print head and the print medium is acquired (S601). Subsequently, the head temperature is acquired (S602). Using the graphs shown in FIGS. 7A and 7B, linear interpolation is performed based on the platen gap value and the head temperature. Thus, the correction value for the difference in ink ejection timing between the forward and backward directions is acquired according to the platen gap value and the head temperature (S603). Then, printing is performed with the ink ejection timing corrected according to the correction value. Thus, one scan of printing is performed (S604). Then, the process determines whether or not all the scans of the predetermined print area for printing on print medium have been finished (S605). If not all the printing for the predetermined print area have been finished, after one scan of printing ends, the print medium is conveyed by a distance equal to a print width corresponding to one scan. Thereafter, the print head starts scanning so as to perform one scan of printing again. A similar process is then repeated until all of the printing of the predetermined area to be printed is finished.

As described above, adjustment patterns are printed with different platen gaps at different print head temperatures. Thus, the relationship between the platen gap and the adjustment value and the relationship between the temperature and the adjustment value are determined. Then, the correction value based on the actual platen gap and the print head temperature is calculated by linear interpolation. Thus, the ink ejection timing is adjusted in association with both a variation in platen gap among each of print media and a variation in head temperature. As a result, even if printing involves both a variation in platen gap among each of print medium and a variation in head temperature, the ink ejection timing is adjusted accordingly, allowing the impact accuracy of ejected ink to be kept high.

(Fourth Embodiment)

Now, a fourth embodiment for carrying out the present invention will be described. Components of the fourth embodiment which are similar to those of the above-described first to third embodiments will not be described below. Only differences from the first to third embodiments will be described.

In the above-described first embodiment, the ink ejection timing is adjusted for each scan based on the print head temperature. In the above-described second embodiment, the ink ejection timing is adjusted at predetermined time intervals according to the print head temperature. Furthermore, in the third embodiment, the ink ejection timing can be adjusted according to both the platen gap condition and the print head temperature condition. In contrast, in the present embodiment, when the print head performs scanning for a predetermined number of columns in one scan, the platen gap in the scan is detected. Then, a correction value is calculated for every predetermined number of columns, and the ink ejection timing is corrected. For the print head temperature, the head temperature is detected for each scan. A correction value is then calculated according to the print head temperature acquired, and the ink ejection timing is corrected.

Since printing is performed in this manner, the ink ejection timing is corrected in association with a variation in the temperature of the print head. Furthermore, while the print head is performing scanning, the ink ejection timing is corrected in association with a variation in platen gap during the scanning. Consequently, the ink ejection timing can be adjusted in association with both a variation in the temperature of the print head and a variation in the thickness of the print medium. The adjustment of the ink ejection timing according to this method will be described below.

A printing method for forming adjustment patterns and a method for calculating a correction value according to the present embodiment are similar to those in the above-described embodiments. In the present embodiment, a plurality of platen gap detection positions are set in the direction in which the print head performs scanning. In the present embodiment, a plurality of platen gap detection positions are set in the direction in which the print head 201 performs scanning. The platen gap detection positions, the positions where the platen gap is detected, are set at uniform intervals each corresponding to a predetermined number of columns in the width direction of the print medium. When a print head 201 reaches the platen gap detection position, an optical sensor 203 serving as platen gap detecting device detects the platen gap at the position.

In the present embodiment, when adjustment patterns used to set a correction value are formed, the formation is carried out at each of position of which intervals between adjacent positions correspond to predetermined number of columns. This allows setting of the correction value for the ink ejection timing which is suitable for the thickness of the print medium at a position corresponding to every predetermined number of columns.

Figure 9A:
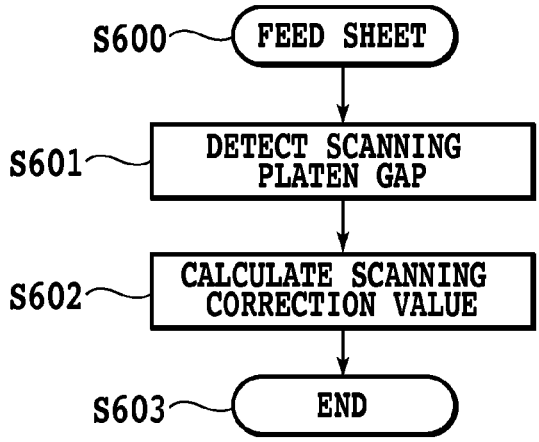
FIG. 9A to FIG. 9C are flowcharts showing the flow of a printing method according to a fourth embodiment of the present invention.
Figure 9B:
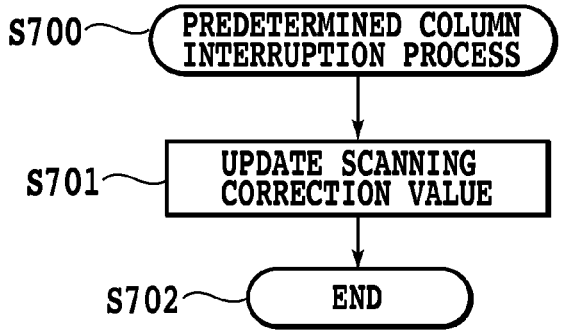
Figure 9C:
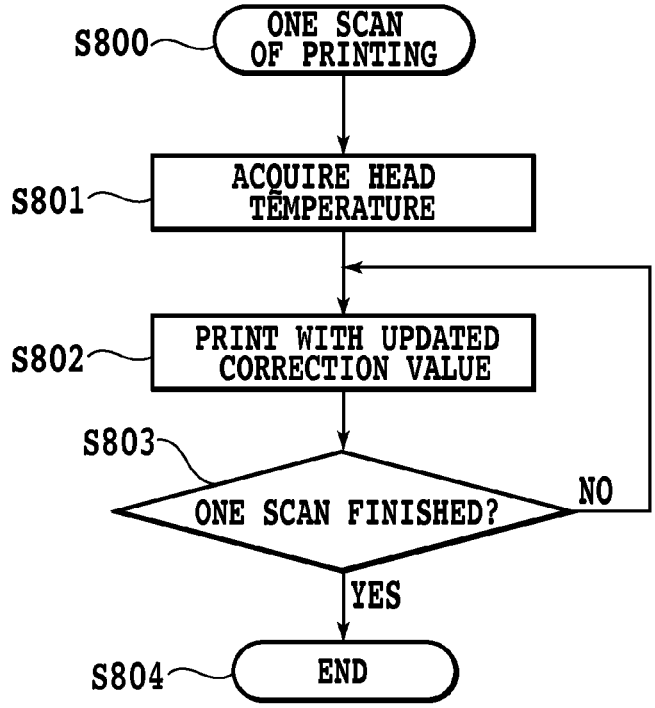

FIG. 9A to FIG. 9C are flowcharts of a printing method according to the present embodiment. FIG. 10 is a table showing the platen gap value during scanning and the correction value at each head temperature according to the present embodiment.

First, during feeding of a print medium, a platen gap value during scanning is detected (S601). Then, a correction value during scanning is calculated (S602). On the other hand, an interruption process in predetermined column unit is executed during printing scan (S700) to update a correction value during scanning (S701). Here, N predetermined positions POS1 to POSN in FIG. 10 correspond to update positions such that the ink ejection timing is updated when the print head is placed at one of the positions POS1 to POSN. FIG. 10 shows adjustment values for the ejection timing at the respective temperatures of the print head for each of the platen gap detection positions POS1 to POSN.

During one scan of printing, first, the temperature of the print head is acquired at the beginning of the scan (S801). Then, the correction value corresponding to the temperature and the platen gap as an initial value is calculated. Printing is then performed with the ink ejection timing adjusted using the correction value. Thereafter, during scanning of the print head, the print head reaches a predetermined position located at a distance corresponding to a predetermined number of columns from the initial position. Then, the platen gap is detected, and based on the detected platen gap, a correction value is calculated for updating. Printing is then performed using the updated correction value (S802). In this manner, the platen gap used to adjust the difference in ejection timing is updated every time the print head reaches the platen gap detection position. When the correction value is updated, the process determines whether or not one scan has been finished (S803). If one scan has been finished, the print medium is conveyed by a predetermined amount, and the next scan of printing is then started. If one scan has not been finished, a similar process is repeated.

As described above, while the print head is performing scanning, the platen gap value is detected at every predetermined intervals, and the ink ejection timing is corrected according to the detected platen gap. Furthermore, the ink ejection timing is corrected for each scan according to the print head temperature. Thus, the ink ejection timing can be adjusted in association with both a variation in platen gap and a variation in print head temperature. Consequently, printing can be performed at ink ejection timings suitable for printing conditions. Therefore, the impact accuracy of ejected ink is kept high.

(Other Embodiments)

When the ink ejection timing is adjusted using adjustment patterns, if a roughly adjusted pattern group and a precisely adjusted pattern group can be formed, the ejection timing may be adjusted using only the precisely adjusted pattern group. In this manner, the ink ejection timing based on the roughly formed pattern group may be omitted, thus reducing the time required to print adjustment patterns.

The term "printing" as used herein means not only the application of a meaningful image such as a character or a graphic to a print medium but also the application of a meaningless image such as a pattern. Furthermore, the term "ink" or "liquid" should be broadly interpreted and refers to a liquid applied onto a print medium to form an image, a pattern, or the like, process the print medium, or treat the ink or the print medium. Here, the treatment of the ink or the print medium refers to, for example, improvement of fixability resulting from solidification or insolubilization of a color material in the ink applied to the print medium, improvement of printing quality or coloring ability, or improvement of image permanence.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-323733, filed Dec. 19, 2008, which is hereby incorporated by reference herein in its entirety.

What is claimed is:

1. An image control apparatus for controlling image formation on a print medium by ejecting ink from a print head that includes ejection nozzles through which the ink is ejected while the print head moves in a forward direction and a backward direction, the image control apparatus comprising:

a temperature obtaining unit for obtaining information about a temperature of the print head during image formation;

a pattern printing control unit for causing the print head to print a first adjustment pattern and a second adjustment pattern, each of which is printed at a first temperature and at a second temperature which is different from the first temperature; and a determination unit for determining a relative timing of an ink ejection in the forward direction to an ink ejection in the backward direction during image formation at a third temperature by interpolating a first relative timing and a second relative timing, each of which are acquired from the first adjustment pattern and the second adjustment pattern printed by the pattern printing control unit.

2. The image control apparatus according to claim 1, wherein the determination unit determines the relative timing during image formation at the third temperature by linearly interpolating the first relative timing and the second relative timing.

3. The image control apparatus according to claim 1, wherein the temperature obtaining unit obtains the information about the temperature of the print head during one of a plurality of movements of the print head, and wherein the determination unit determines the relative timing during one of the plurality of movements of the print head at the third temperature.

4. An image control method for controlling image formation on a print medium by ejecting ink from a print head that includes ejection nozzles through which the ink is ejected while the print head moves in a forward direction and a backward direction, the image control method comprising:

a temperature obtaining step for obtaining information about a temperature of the print head during image formation;

a pattern printing control step for causing the print head to print a first adjustment pattern and a second adjustment pattern at a first temperature and at a second temperature, which is different from the first temperature; and a determination step for determining a relative timing of an ink ejection in the forward direction to an ink ejection in the backward direction during image formation at a third temperature by interpolating a first relative timing and a second relative timing, each of which are acquired from the first adjustment pattern and the second adjustment pattern printed in the pattern printing control step.

5. The image control method according to claim 4, wherein the the relative timing during image formation at the third temperature is determined, in the determination step, by linearly interpolating the first relative timing and the second relative timing.

6. The image control method according to claim 4, wherein the information about the temperature of the print head is obtained, in the obtaining step, during one of a plurality of movements of the print head, and wherein the relative timing is determined, in the determination step, during the one of plurality of movements of the print head at the third temperature.

7. A non-transitory computer readable storage medium storing a computer-executable program for executing a method of forming an image on a print medium by ejecting ink from a print head that includes ejection nozzles through which ink is ejected, while moving the print head in a forward direction and a backward direction, the method comprising;

a temperature obtaining step for obtaining information about a temperature of the print head during image formation;

a pattern printing control step for causing the print head to print a first adjustment pattern and a second adjustment pattern at a first temperature and at a second temperature, which is different from the first temperature; and a determination step for determining a relative timing of an ink ejection in the forward direction to an ink ejection in the backward direction during image formation at a third temperature by interpolating a first relative timing and a second relative timing, each of which are acquired from the first adjustment pattern and the second adjustment pattern printed in the pattern printing control step.

8. The storage medium according to claim 7, wherein the relative timing during image formation at the third temperature is determined, in the determination step, by linearly interpolating the first relative timing and the second relative timing.

9. The storage medium according to claim 7, wherein the information about the temperature of the print head is obtained, in the obtaining step, during one of a plurality of movements of the print head, and wherein the relative timing is determined, in the determination step, during the one of plurality of movements of the print head at the third temperature.

* * * * *